US010794592B2

(12) United States Patent
Huang et al.

(10) Patent No.: US 10,794,592 B2
(45) Date of Patent: Oct. 6, 2020

(54) INFRARED RAY GENERATION MESH

(71) Applicant: Grand Mate Co., Ltd., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 32 days.

(21) Appl. No.: 16/164,497

(22) Filed: Oct. 18, 2018

(65) Prior Publication Data

US 2020/0124278 A1 Apr. 23, 2020

(51) Int. Cl.
*F23D 14/14* (2006.01)
*F24C 15/24* (2006.01)

(52) U.S. Cl.
CPC ..... *F23D 14/145* (2013.01); *F24C 15/24* (2013.01)

(58) Field of Classification Search
None
See application file for complete search history.

(56) References Cited

U.S. PATENT DOCUMENTS 2,244,045 A * 6/1941 Bobo ..... F24C 15/24 126/41 R
3,122,197 A * 2/1964 Saponara ..... F23D 14/145 431/329
3,857,670 A * 12/1974 Karlovetz ..... D06F 67/02 431/329
5,989,013 A * 11/1999 Gray ..... F23D 14/14 126/92 AC
2011/0056145 A1* 3/2011 Lenney ..... E04D 13/076 52/12
2011/0165300 A1* 7/2011 Roychoudhury ..... F23C 13/00 426/523
2012/0193337 A1* 8/2012 Barber ..... F21C 15/22 219/201
2015/0101593 A1* 4/2015 Fowler ..... F24C 3/047 126/41 R

FOREIGN PATENT DOCUMENTS

JP 2006218255 A * 8/2006

* cited by examiner

*Primary Examiner* — James Choi
(74) *Attorney, Agent, or Firm* — R. Lynette Wylie; Apex Juris, pllc.

(57) ABSTRACT

An infrared ray generation mesh adapted to a combustion device comprising a mesh body which includes a first surface and a second surface positioned back-to-back, and a peripheral edge which has a first part and a second part on opposite sites. Wherein, the mesh body is bent or folded integrally to form a plurality of corrugations, each of the corrugations extending from the first part to the second part; and the mesh body is flame heated to generate infrared rays. Whereby, the infrared ray generation mesh improves accumulation of thermal energy generated by open fire, such that the heating range of infrared rays is getting wider and the infrared intensity per unit area is higher to achieve better heat control.

17 Claims, 15 Drawing Sheets

INFRARED RAY GENERATION MESH

BACKGROUND OF THE INVENTION

1. Technical Field

The present invention is related to a heating device, and more particularly to an infrared ray generation mesh which is utilized in an infrared combustion device.

2. Description of Related Art

Among combustion devices, a common way to heat an object is to utilize open fire generated by a combustion device. However, heat is conducted from the surface of the object to the interior thereof when heating the object, resulting in the object not being heated uniformly. Taking food heating as an example, the outer surface of food will be first heated by thermal energy which is generated by the open fire, and the thermal energy is then conducted gradually to the interior of the food. It often brings about overheating on food surface but being undercooked in the interior.

At present, a combustion device that generates infrared rays has been developed to solve the problem of uneven heating of objects. Among conventional combustion devices 1, a common way to generate infrared rays is to apply open fire to a ceramic plate 2 (as shown in FIG. 1) for heating the ceramic plate 2 to form an infrared heat source. However, since ceramic plates 2 are generally flat plates in shape, it is difficult to efficiently increase the scattering surface area of infrared rays, and so are the scattering range and the intensity, resulting in the impossibility for further increasing the heat temperature provided by the combustion device that generates infrared rays.

Hence, there remains a persisting need to provide an improvement on the design of the conventional combustion devices generating infrared rays so as to overcome the aforementioned drawbacks.

BRIEF SUMMARY OF THE INVENTION

In view of the above, a purpose of the present invention is to provide an infrared ray generation mesh for enlarging the infrared ray heat range created by a combustion device.

The present invention provides an infrared ray generation mesh comprising a mesh body which includes a first surface and a second surface positioned back-to-back and a peripheral edge having a first part and a second part on opposite sites. Wherein, the mesh body is bent or folded integrally to form a plurality of corrugations, each of the corrugations extending from the first part to the second part; and the mesh body is flame heated to generate infrared rays.

The advantage of the present invention is to further improve accumulation of thermal energy generated by open fire, such that the heating range of infrared rays is getting wider and the infrared intensity per unit area is higher to achieve better heat control.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

The following illustrative embodiments and drawings are provided to illustrate the disclosure of the present invention, these and other advantages and effects can be clearly understood by persons skilled in the art after reading the disclosure of this specification.

Figure 1:
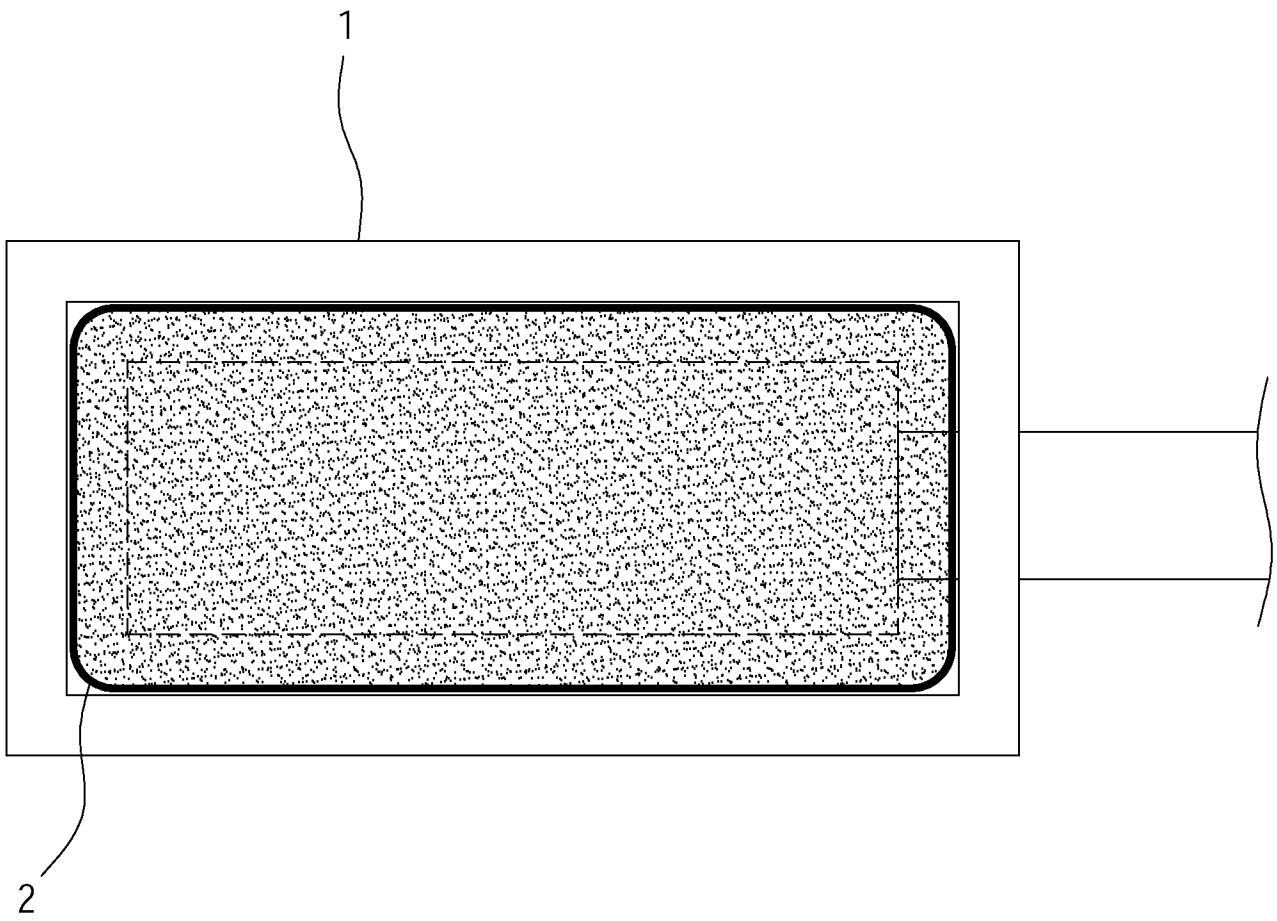
FIG. 1 [ PRIOR ART ]
FIG. 1 is a conventional combustion device generating infrared rays.
Figure 2:
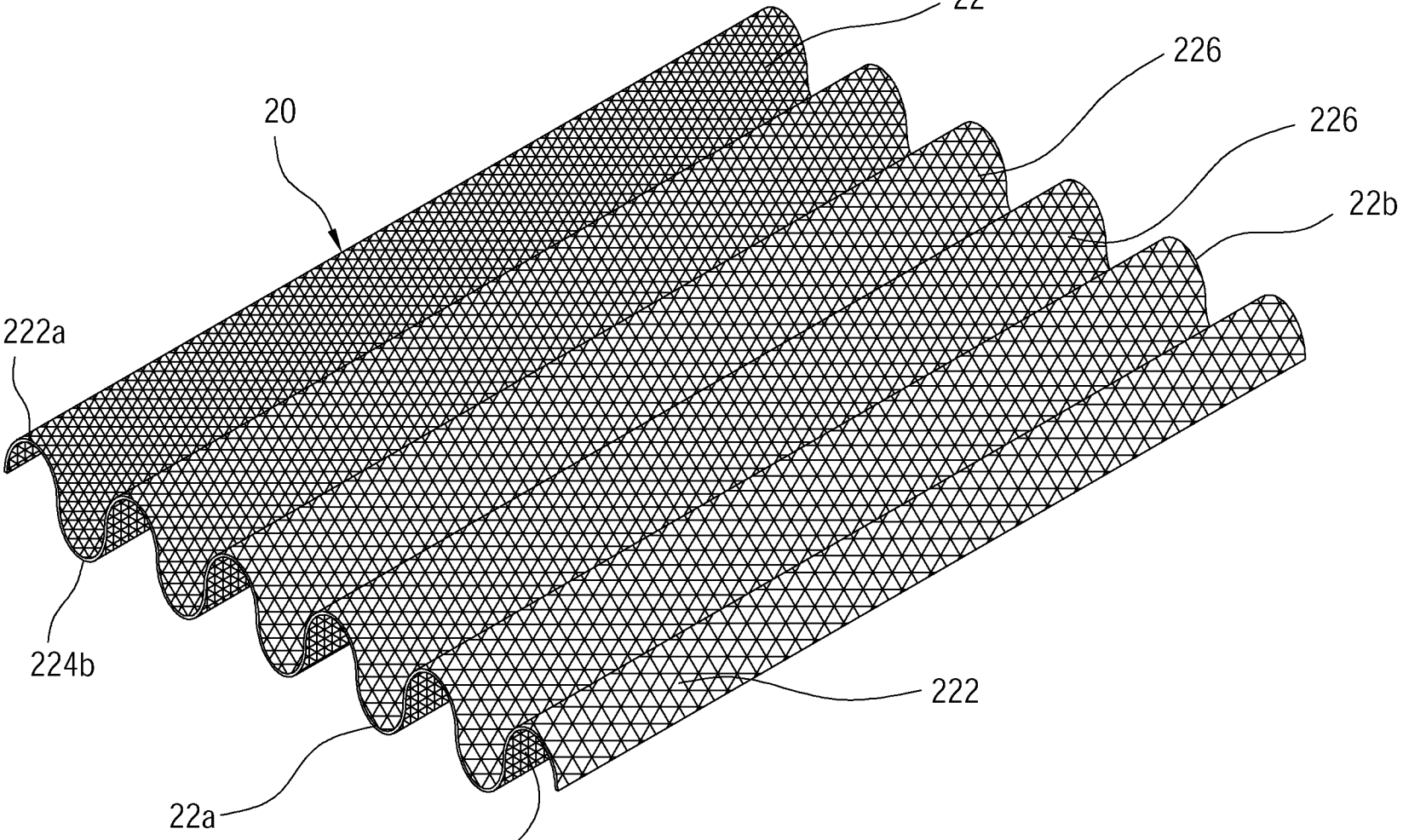
FIG. 2 is a perspective view of an infrared ray generation mesh of a first embodiment according to the present invention.
Figure 3:
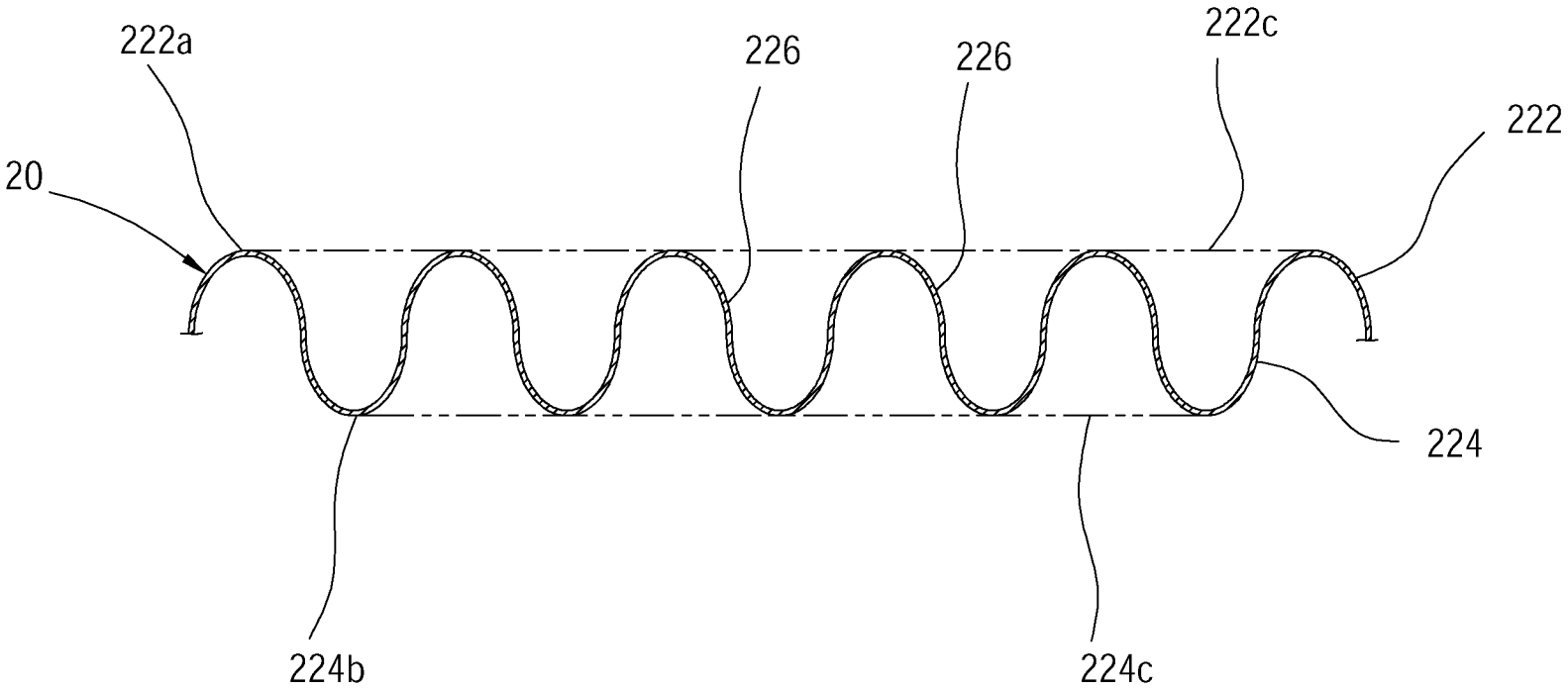
FIG. 3 is a cross-sectional view of the infrared ray generation mesh of the first embodiment.

As illustrated in FIG. 2 and FIG. 3, there is shown an infrared ray generation mesh 20 of a first embodiment according to the present invention.

As illustrated in FIG. 2, the infrared ray generation mesh 20 is metallic material and, in the current embodiment, is iron-chromium-aluminum alloy. The infrared ray generation mesh includes a flat rectangular mesh body 22 which has a first surface 222 and a second surface 224 positioned back-to-back and a peripheral edge as well, wherein the first surface 222 is not shielded but exposed outside directly. The peripheral edge has four sides and two of the opposite ones form a first part 22*a* and a second part 22*b*. In practice, the peripheral edge of the mesh body 22 can be circular and be divided into two halves by a diameter thereof, wherein the first part 22*a* and the second part 22*b* are located respectively on the two halves.

The mesh body 22 is bent or folded integrally to form a plurality of corrugations 226 which extend parallel from the first part 22*a* to the second part 22*b*. As shown in FIG. 3, a cross section of the corrugations 226 is waved. Wherein, the corrugations 226 have a plurality of first crests 222*a* on the first surface 222 and the first crests 222*a* are located on a defined first reference surface 222*c*; the corrugations 226 have a plurality of second crests 224*b* on second surface 224 and the second crests 224*b* are located on a defined second reference surface 224*c*. In the current embodiment, the first reference surface 222*c* and the second reference surface 224*c* are both flat; in other words, the first crests 222*a* are on the same plane and the second crests 224*b* are on another same plane, but it is not limited thereto. The first crests 222*a* need not be on the same plane and the second crests 224*b* need not be on another same plane either.

Furthermore, the mesh body 22 of the infrared ray generation mesh 20 has a cover rate ranging from 43% to 64% per unit area. In the current embodiment, each wire diameter of the mesh body 22 is 0.2 mm and the mesh body 22 has 1600 mesh pores (40×40=1600) per square inch. It is able to be deduced that each opening area of the mesh pores per square inch is 302.76 $mm^2$ with the formula of $(25.4-(40\times 0.2))^2=302.76$. Meanwhile, the mesh body 22 has a cover rate of 53.07% with the formula of $(25.4^2-302.76)/(25.4^2)\times 100\%=53.07\%$. Thus, more preferably, the cover rate per unit area of the mesh body 22 is about 53%~54%.

Figure 4:
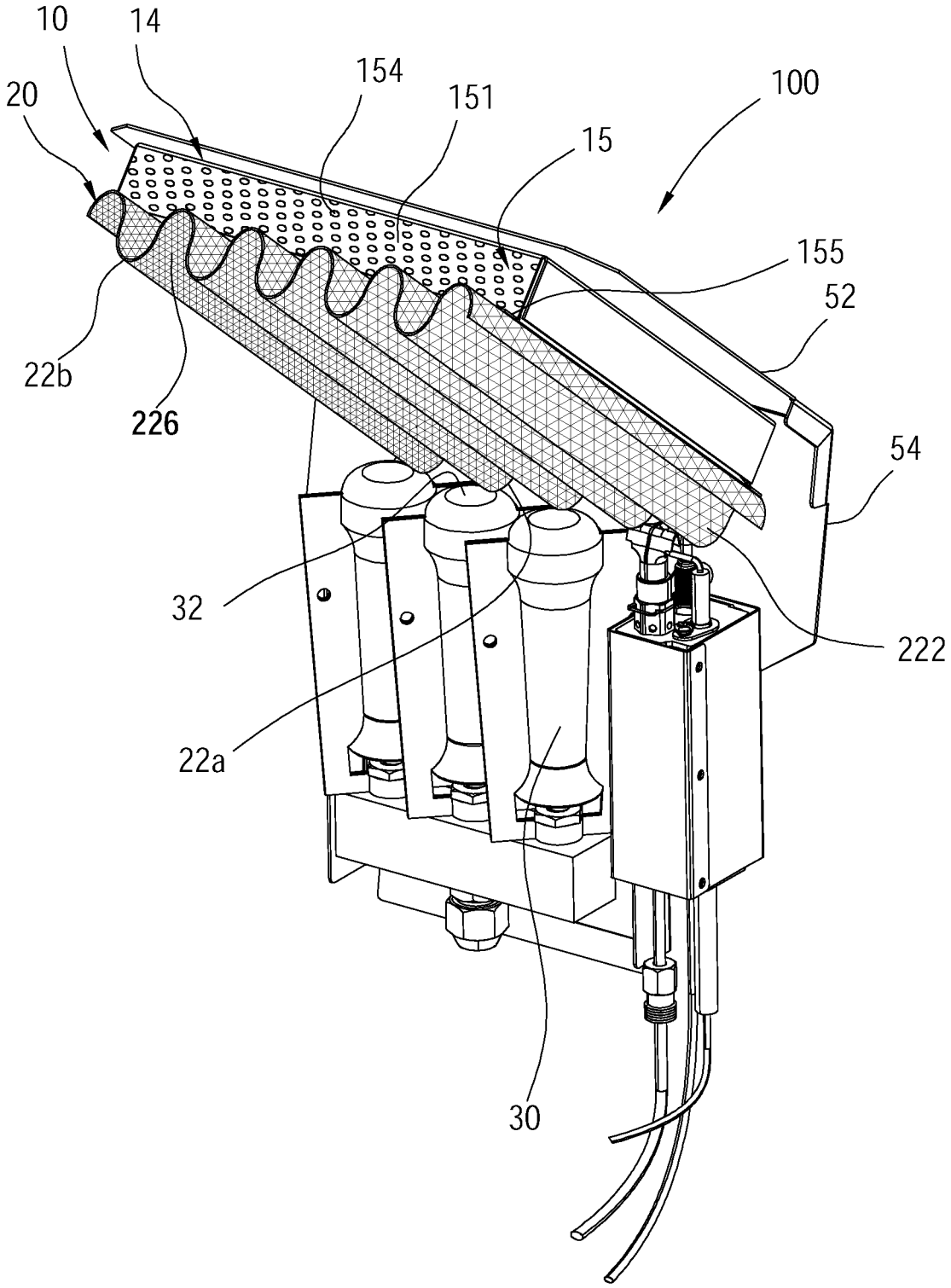
FIG. 4 is a perspective view of a combustion device having the infrared ray generation mesh of the first embodiment.
Figure 5:
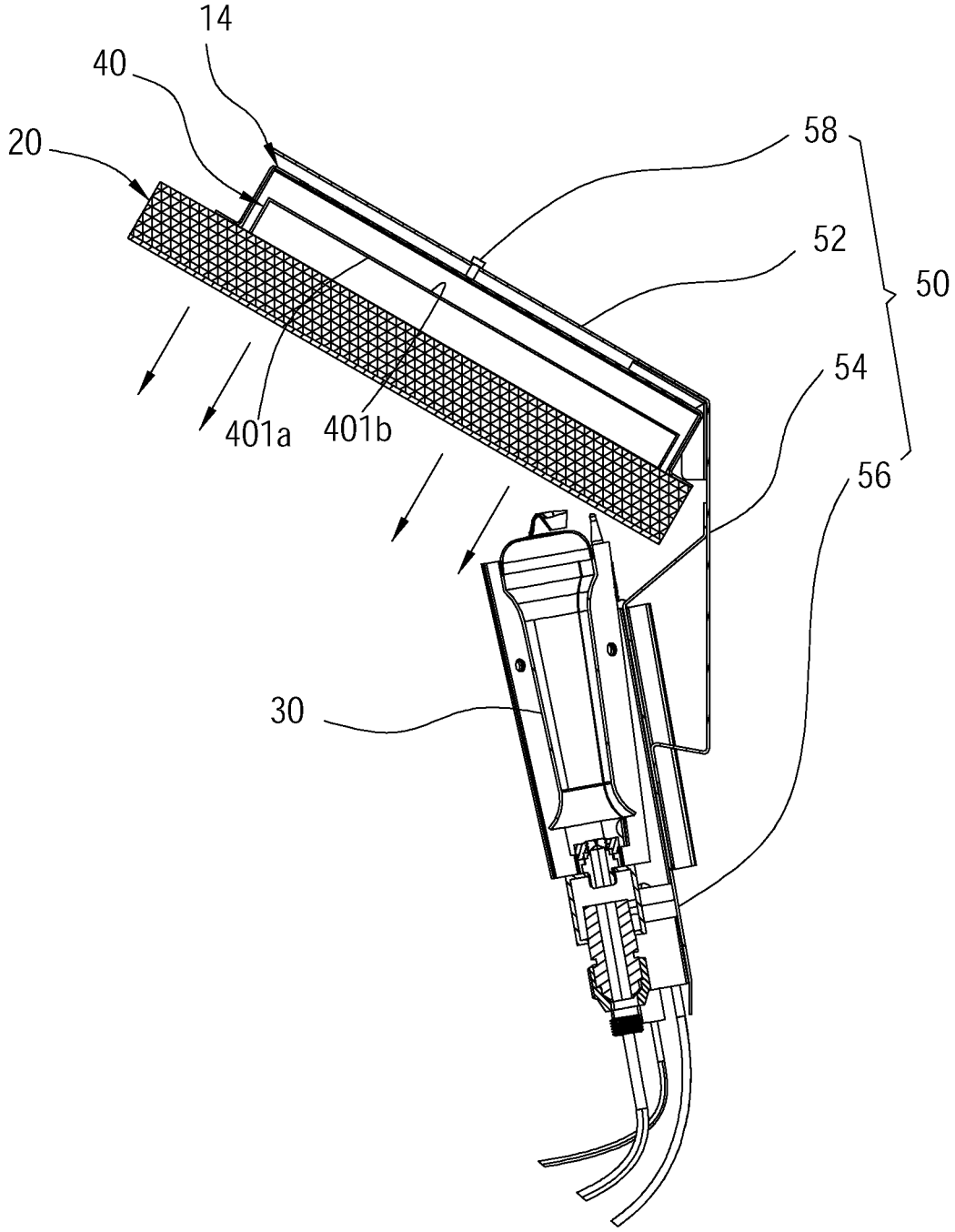
FIG. 5 is a cross-sectional view of the combustion device of FIG. 4.
Figure 6:
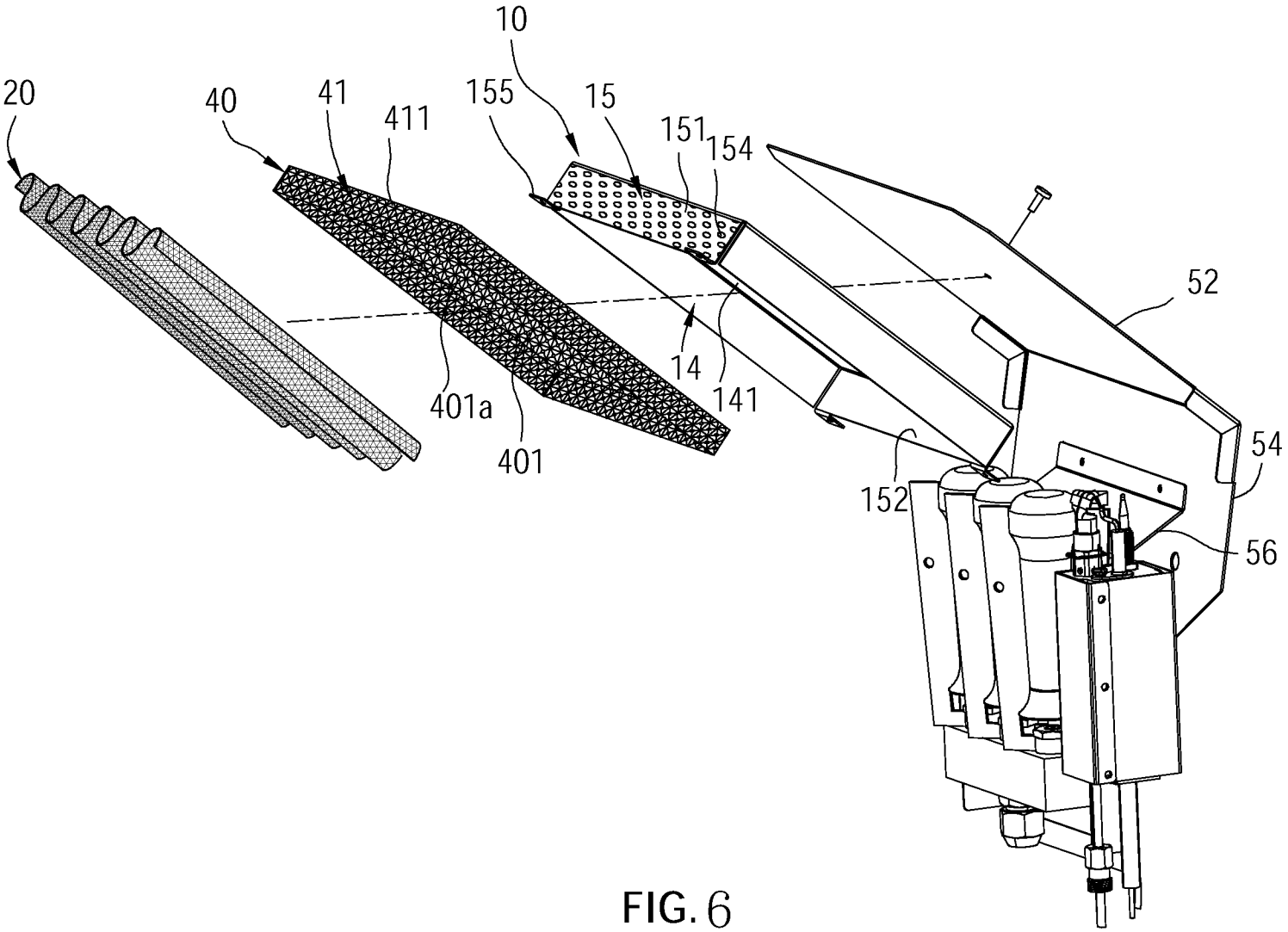
FIG. 6 is an exploded view of the combustion device of FIG. 4.

As illustrated in FIG. 4 to FIG. 6, there is shown a combustion device 100 utilizing the aforementioned infrared ray generation mesh 20. The combustion device 100 includes a supporting assembly 10, an infrared reflective plate 40 and at least one burner 30.

As illustrated in FIG. 6, the supporting assembly 10 includes a metallic rear cover 14 which is tilted and has a flat rectangular rear plate 141. The rear cover 14 includes a surrounding wall 15 connected to a peripheral edge of the rear plate 141. The surrounding wall 15 comprises an upper side wall 151 and a lower side wall 152, wherein the upper side wall 151 is connected to a top edge of the rear plate 141 and has a plurality of holes 154 passing between an interior surface and an exterior surface of the upper side wall 151. The surrounding wall 15 of the rear cover 14 extends outwardly to form a plurality of extension parts 155, wherein the infrared ray generation mesh 20 is joined to the extension parts 155 by bolt-nut combining or welding to fix the infrared ray generation mesh 20 to the rear cover 14. In the current embodiment, the extension parts 155 are located respectively on the upper side wall 151 and the lower side wall 152.

As illustrated in FIG. 4, the at least one burner 30 has a flame outlet 32 near the first part 22*a* of the infrared ray generation mesh 20, and the first surface 222 corresponds to the flame outlet 32. The at least one burner 30 is for burning gas to generate flames through the flame outlet 32, whereby the flames are applied to the infrared ray generation mesh 20 and flows along corrugations 226 from the first part 22*a* toward the second part 22*b*. In the current embodiment, there are a plurality of burners 30, each flame outlet 32 of which generates flames and heats the infrared ray generation mesh 20. In practice, it works as long as the flames are applied to the infrared ray generation mesh 20, that is, it is feasible as long as the flame outlets 32 of the burners 30 are disposed near the infrared ray generation mesh 20.

As illustrated in FIG. 5, the infrared reflective plate 40 is disposed between the rear cover 14 of the supporting assembly 10 and the infrared ray generation mesh 20. The infrared reflective plate 40 which is tilted includes a flat rectangular main board 401 (as shown in FIG. 6) corresponding to the infrared ray generation mesh 20, and the infrared reflective plate 40 further comprises a surrounding wall 41 connected to a peripheral edge of the main board 401. The surrounding wall 41 of the infrared reflective plate 40 has an upper side wall 411 connected to a top edge of the main board 401, wherein a height of the surrounding wall 41 of the infrared reflective plate 40 is lower than that of the surrounding wall 15 of the rear cover 14. The infrared reflective plate 40 includes a reflective surface 401*a* and an exterior surface 401*b* positioned back-to-back, wherein the reflective surface 401*a* facing the infrared ray generation mesh 20 reflects back infrared rays generated by the infrared ray generation mesh 20, such that the reflected infrared rays apply to the infrared ray generation mesh 20 and emit outwardly. The infrared reflective plate 40 is metallic, such as stainless steel.

In the current embodiment, the combustion device 100 further comprises a bracket 50. As illustrated in FIG. 5, the bracket 50 includes an upper supporting plate 52, a middle supporting plate 54, a lower supporting plate 56 and an engaged member 58. The bracket 50 is for fixing the rear cover 14 and the burners 30 so as to be at the relative position. The middle supporting plate 54 is connected between the upper supporting plate 52 and the lower supporting plate 56. A fixed hole 59 is near the center of the upper supporting plate 52, wherein the engaged member 58 penetrates the fixed hole 59 of the upper supporting plate 52 to fix the rear cover 14 to the upper supporting plate 52, while the burners 30 are fixed to the lower supporting plate 56.

As illustrated in FIG. 5, when flames generated by the flame outlet 32 of the burners 30 heat the infrared ray generation mesh 20, the infrared ray generation mesh 20 is heated by open fire to generate infrared rays. Part of the infrared rays are emitted outwardly from the first surface 222, while another part of the infrared rays are emitted toward the reflective surface 401*a* of the infrared reflective plate 40. The reflective surface 401*a* reflects the another part of the infrared rays toward the infrared ray generation mesh 20 so as to accumulate more thermal energy generated by the infrared rays on the infrared ray generation mesh 20, increase heating the infrared ray generation mesh 20, and rise in temperature to generate more infrared rays. The infrared rays would be emitted outwardly from the infrared ray generation mesh 20 again to reinforce the infrared intensity applied to an object by the combustion device 100.

It is noted that owing to the corrugations 226 of the infrared ray generation mesh 20, the scattering surface area of infrared rays generated by the infrared ray generation mesh 20 is larger than that generated by a conventional flat ceramic plate. In addition, the corrugations 226 extending from first part 222 to the second part 224 help to guide the flames generated by the flame outlet 32 to flow more smoothly along the corrugations 226 from first part 22*a* toward the second part 22*b*, such that the infrared ray generation mesh 20 is heated by the flames more uniformly and the infrared intensity emitted by the combustion device 100 increases. In this way, it is able to enlarge the heating area applied by the infrared rays which are emitted by the combustion device 100, and increase the infrared intensity per unit area. Thus, to adopt the combustion device 100 with a corrugated infrared ray generation mesh 20 not only helps resolve the restriction of heating range but further improves the infrared intensity generated by the combustion device to achieve better fire control.

Figure 7:
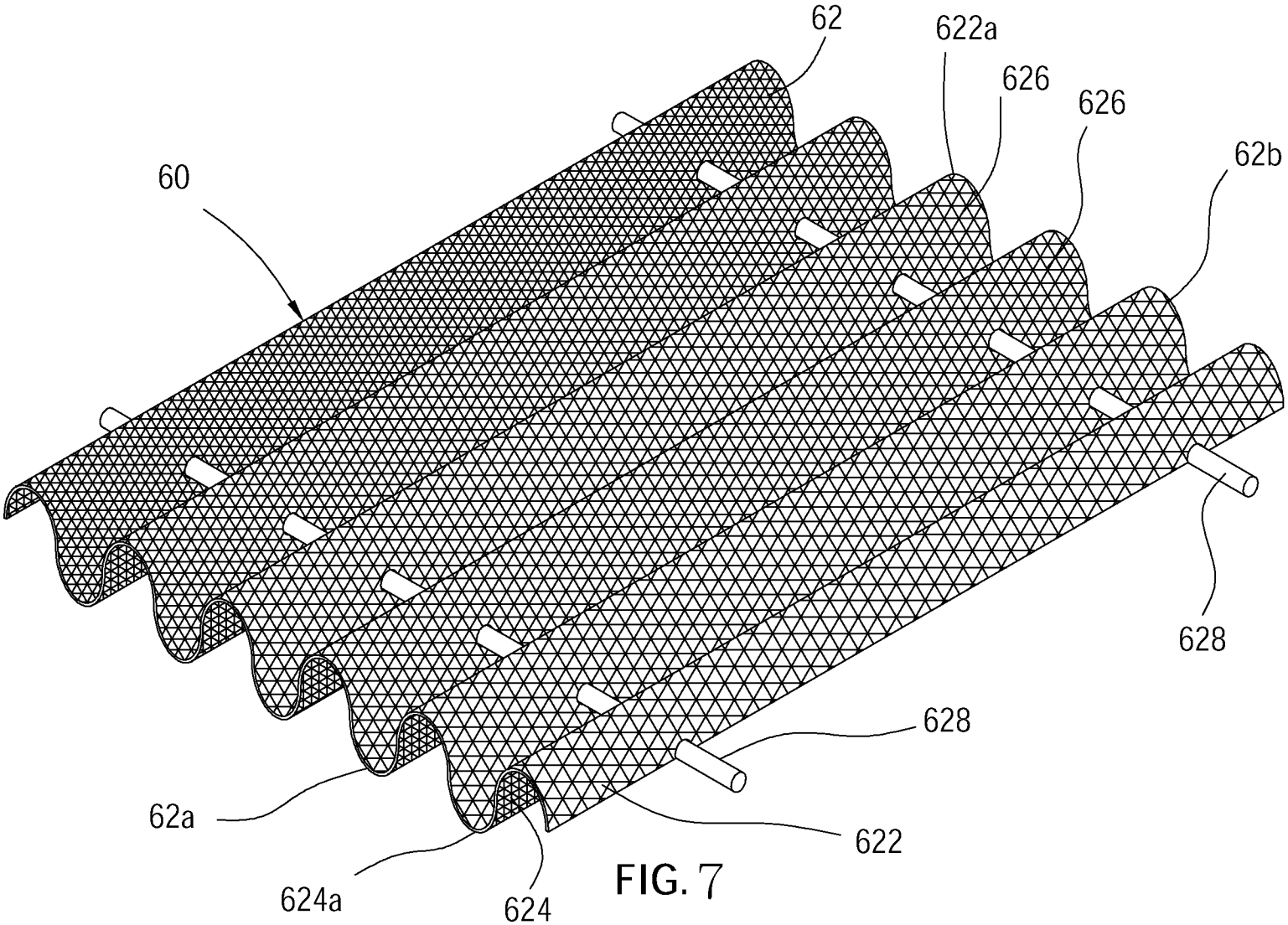
FIG. 7 is a perspective view of an infrared ray generation mesh of a second embodiment.

An infrared ray generation mesh 60 of a second embodiment of the present invention is shown in FIG. 7, wherein the infrared ray generation mesh 60 includes a structure which is similar to that of the second embodiment. The difference between the infrared ray generation mesh 60 of the second embodiment and the infrared ray generation mesh 20 of the first embodiment is that the infrared ray generation mesh 62 is penetrated by at least one fixation bar 628. In the current embodiment, at least one fixation bar 628 includes a plurality of fixation bars 628. The fixation bars 628 are joined to the infrared ray generation mesh 60 by penetrating the first surface 622 and the second surface 624, each of the fixation bars 628 being located between the first crests 622*a* and the second crests 624*b* of the corrugations 626. Additionally, the fixation bars 628 need not penetrate the first surface 622 and the second surface 624, but are joined directly to the infrared ray generation mesh 60 by welding to the first crests 622*a* on the first reference surface 622*c* or the second crests 624*b* on the second reference surface 624*c*. Whereby, the mesh body 62 is fixed by the at least one fixation bar 628 to prevent deformation of the infrared ray generation mesh 60.

Figure 8:
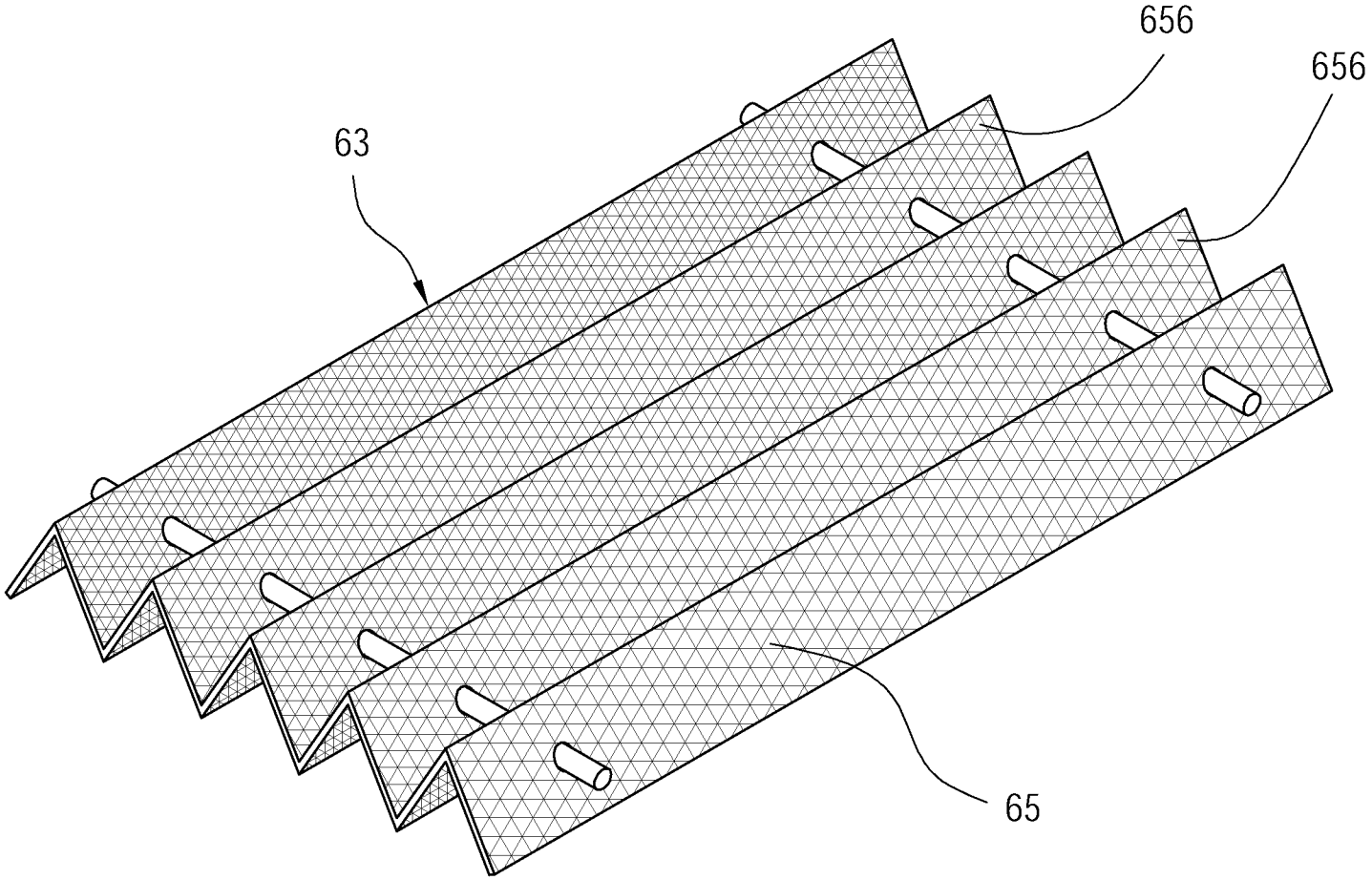
FIG. 8 is a perspective view of an infrared ray generation mesh of a third embodiment.

An infrared ray generation mesh 63 of a third embodiment of the present invention is shown in FIG. 8, wherein the infrared ray generation mesh 63 includes a structure which is similar to that of the second embodiment. The infrared ray generation mesh 63 is different from that of the second embodiment in that a cross section of the corrugations 656 of the infrared ray generation mesh 63 is serrated.

Figure 9:
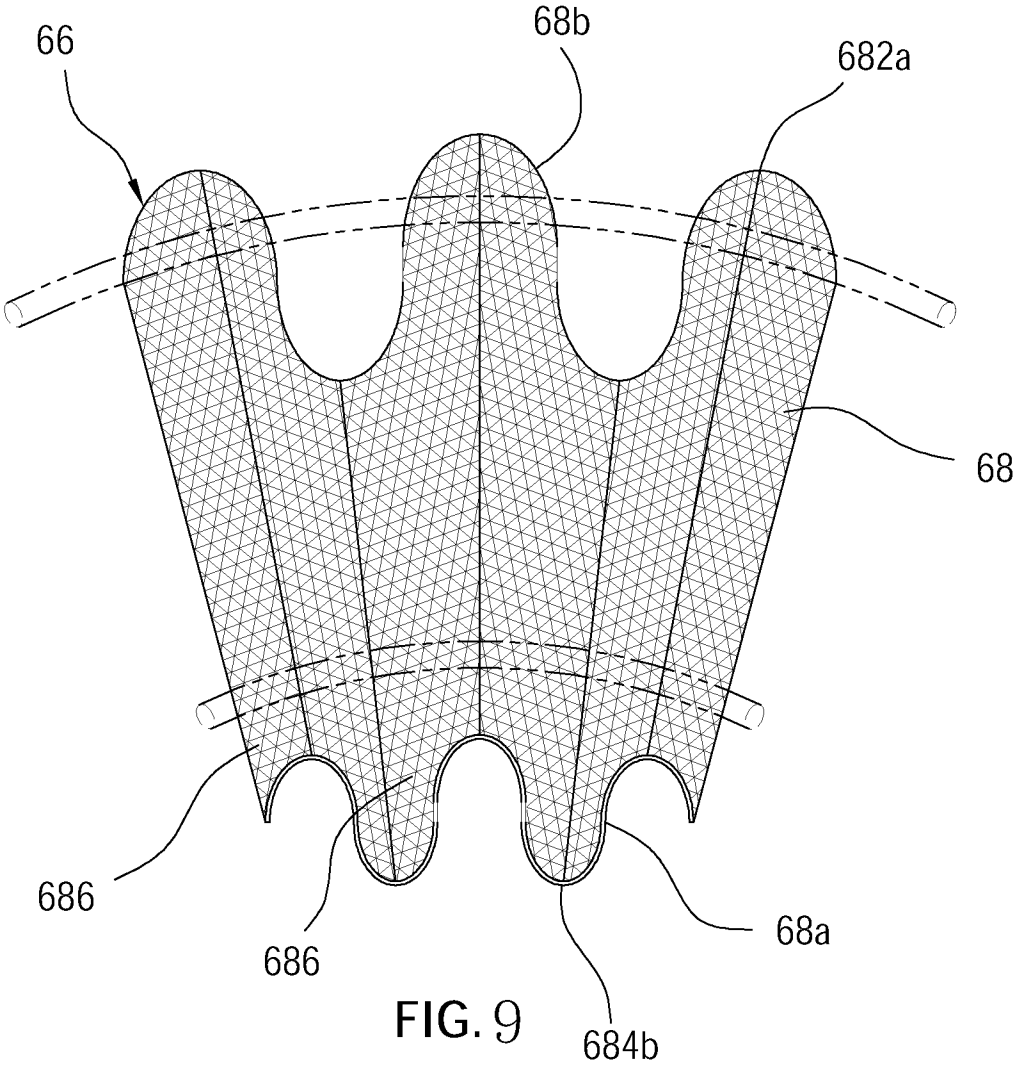
FIG. 9 is a schematic view of an infrared ray generation mesh of a fourth embodiment.

As illustrated in FIG. 9, an infrared ray generation mesh 66 of a fourth embodiment according to the present invention includes a structure which is similar to that of the second embodiment. The infrared ray generation mesh 66 of the current embodiment is different from that of the second embodiment in that a spacing between two adjacent first crests 682*a* and a spacing between two second crests 684*b* of the mesh body 68 are getting larger from the first part 68*a* toward the second part 68*b*, resulting in the fan-shaped mesh body 68 that helps the flames generated by the flame outlet 32 flow along the corrugations 686 from the first part 68*a* to the second part 68*b* and expands the flames range so as to enlarge the infrared rays scattering range of the combustion device 100. In practice, the first crests 682*a* are located on a first reference surface and the second crests 684*b* are located on a second reference surface. The first reference surface and the second reference surface can be a flat or curved surface.

Figure 10:
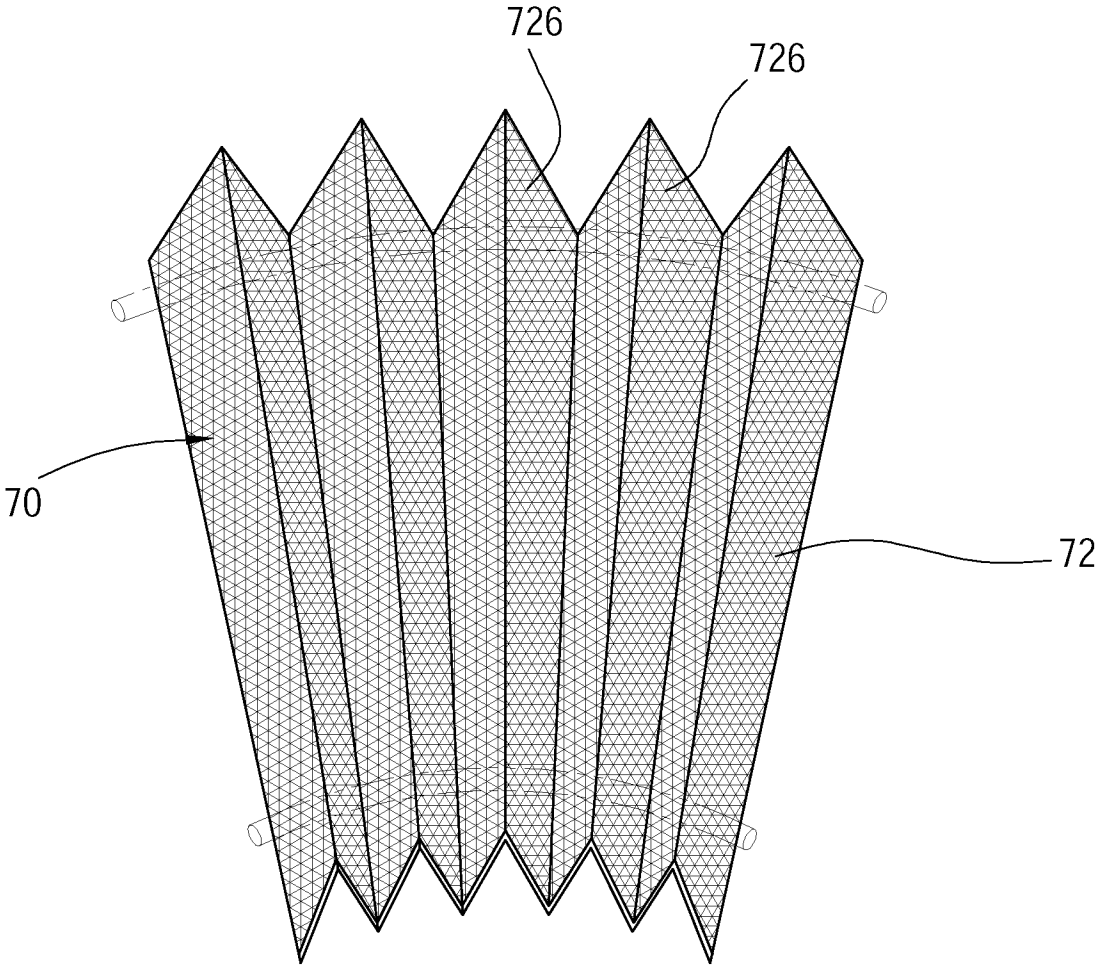
FIG. 10 is a schematic view of an infrared ray generation mesh of a fifth embodiment.

An infrared ray generation mesh 70 of a fifth embodiment of the present invention is shown in FIG. 10, wherein the infrared ray generation mesh 70 includes a structure which is similar to that of the fourth embodiment. The infrared ray generation mesh 70 is different from that of the fourth embodiment in that a cross section of the corrugations 726 of the infrared ray generation mesh 70 is serrated.

Figure 11:
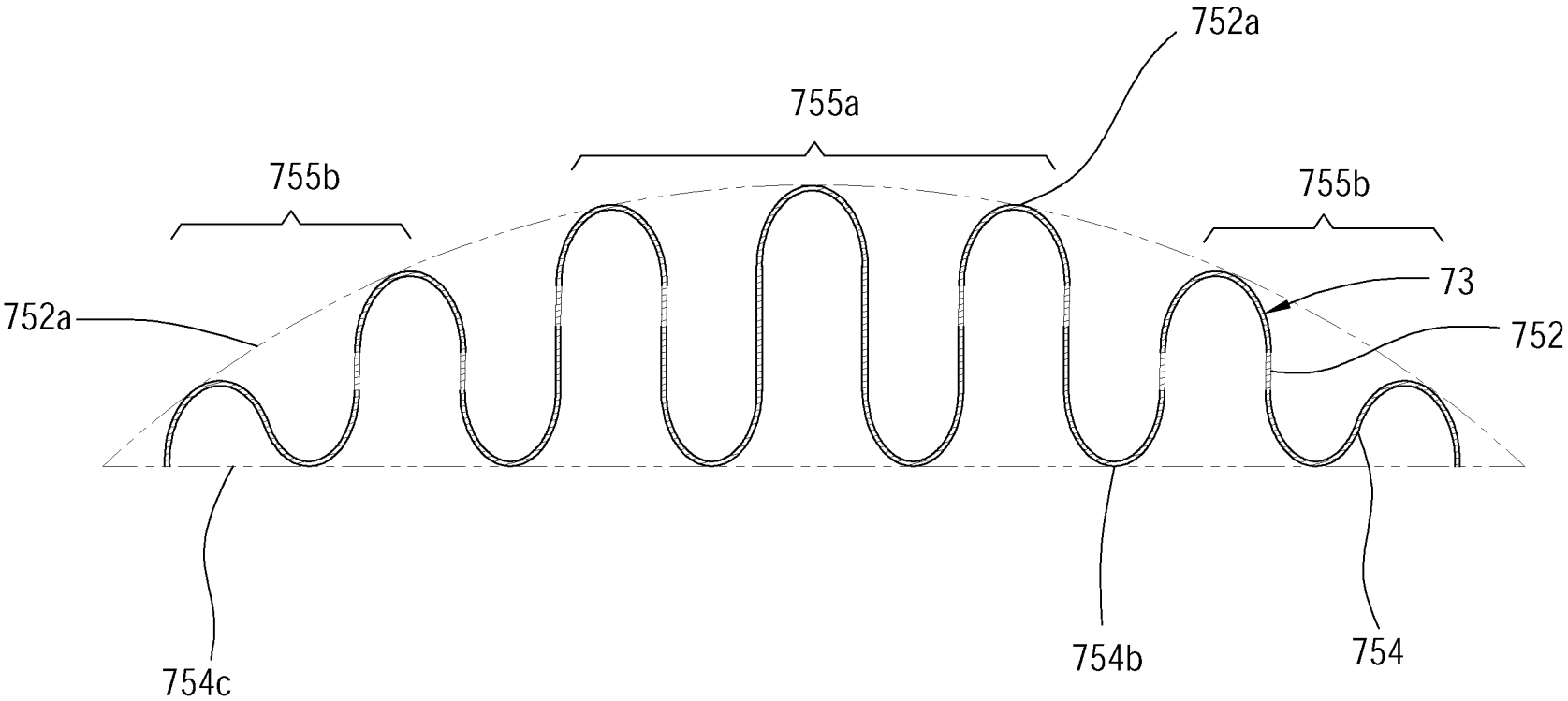
FIG. 11 is a cross-sectional view of an infrared ray generation mesh of a sixth embodiment.

An infrared ray generation mesh 73 of a sixth embodiment of the present invention is shown in FIG. 11. The mesh body 75 includes a middle part 755*a* and two side parts 755*b*, wherein the two side parts 755*b* are located respectively on opposite sides of the middle part 755*a*. A distance from each of the first crests 752*a* to corresponding one of the second crests 754*b* on the middle part 755*a* is larger than that from each of the first crests 752*a* to corresponding one of the second crests 754*b* on the side parts 755*b*, such that the infrared rays scattering angle which are emitted by the facing-outward first surface 752 of the infrared ray generation mesh 73 is greater, resulting in a wider heating range of the combustion device 100. In practice, the first crests 752*a* can be located on a first reference surface 752*c* and the second crests 754*b* can be on a second reference surface 754*c*. The first reference surface 752*c* can be a curved surface while the second reference surface 754*c* can be a flat or curved surface.

Figure 12:
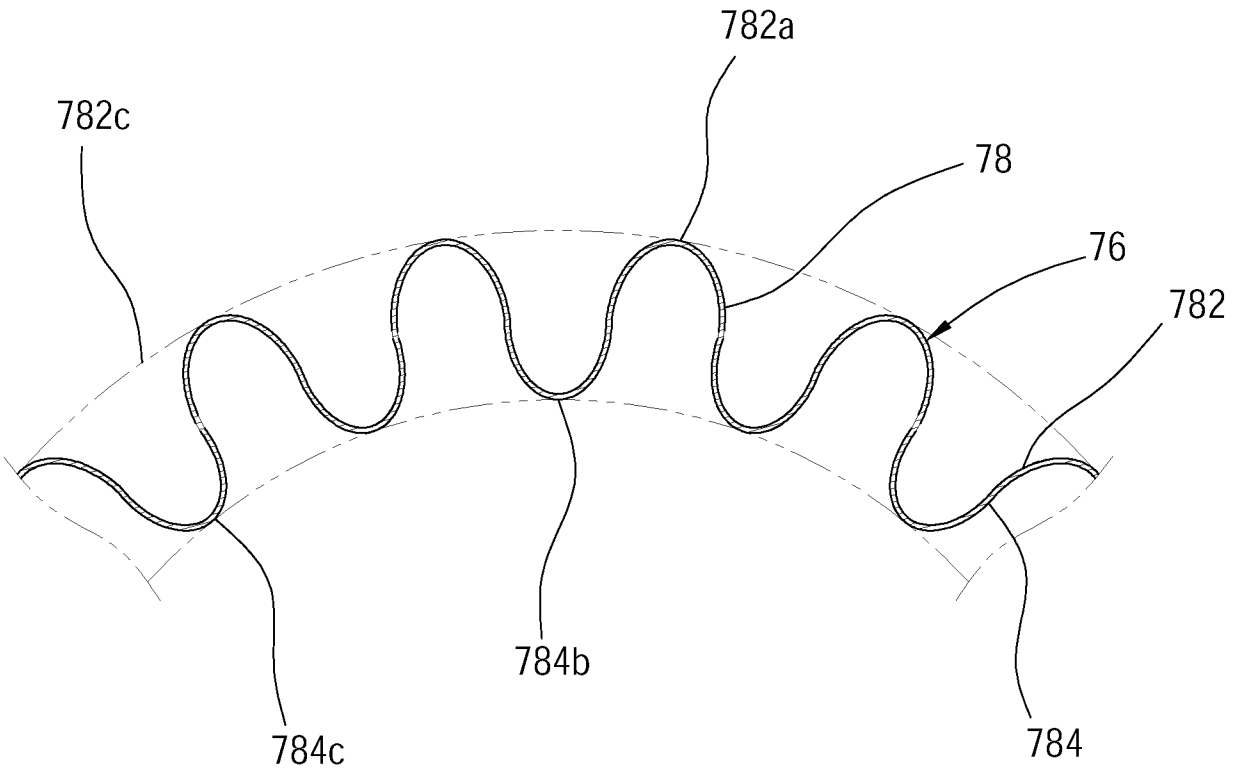
FIG. 12 is a cross-sectional view of an infrared ray generation mesh of a seventh embodiment.

An infrared ray generation mesh 76 of a seventh embodiment of the present invention is shown in FIG. 12. Wherein, a first reference surface 782*c* and a second reference surface 784*c* are both curved surfaces, resulting in a greater scattering angle of the infrared rays emitted by the infrared ray generation mesh 76 and a wider heating range of the combustion device 100.

Through the aforementioned structures, the scattering surface area of infrared rays emitted from the first surface and the second surface is greater due to the corrugations of the infrared ray generation mesh, resulting in a wider heating range of infrared rays.

Figure 13:
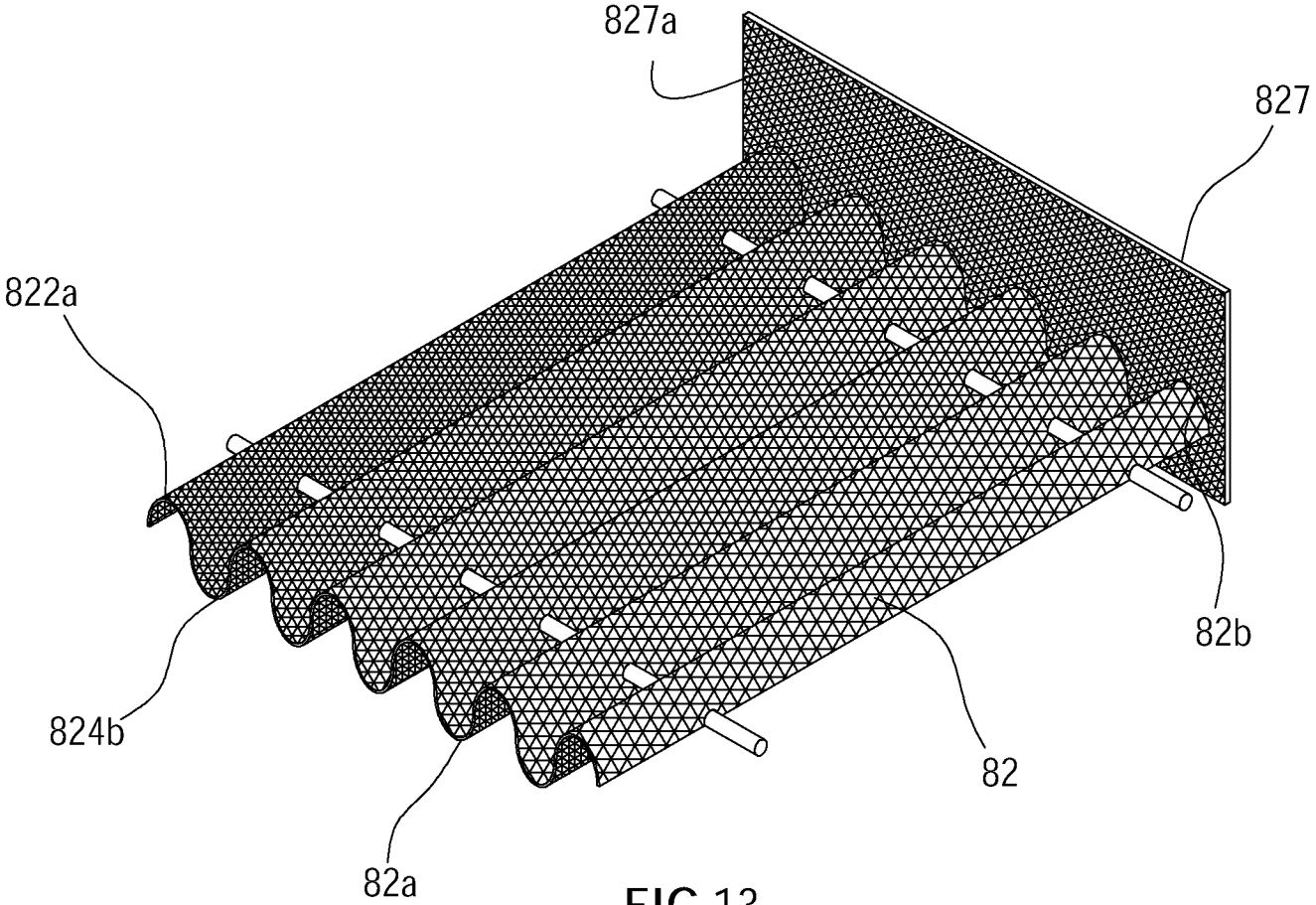
FIG. 13 is a perspective view of an infrared ray generation mesh of an eighth embodiment.

An infrared ray generation mesh of an eighth embodiment of the present invention is shown in FIG. 13. Besides a mesh body 82, the infrared ray generation mesh further includes a retaining mesh 827 disposed corresponding to the second part 82*b*. An angle θ is formed between a surface 827*a* of the retaining mesh 827 and a long axis of each of the first crests 822*a*, wherein the angle θ is equal to or greater than 90 degrees, and more preferably, between 90 and 135 degrees. The retaining mesh 827 can be joined to the second part 82*b* by welding, locking or binding. In addition, it is able to integrally bend an infrared ray generation mesh to form the retaining mesh 827 and the mesh body 82. Incidentally, the retaining mesh 827 could be utilized in the mesh body of the first to the seventh embodiments while the means of integrally bending could be utilized in the infrared ray generation mesh of the first to the seventh embodiments.

Figure 14:
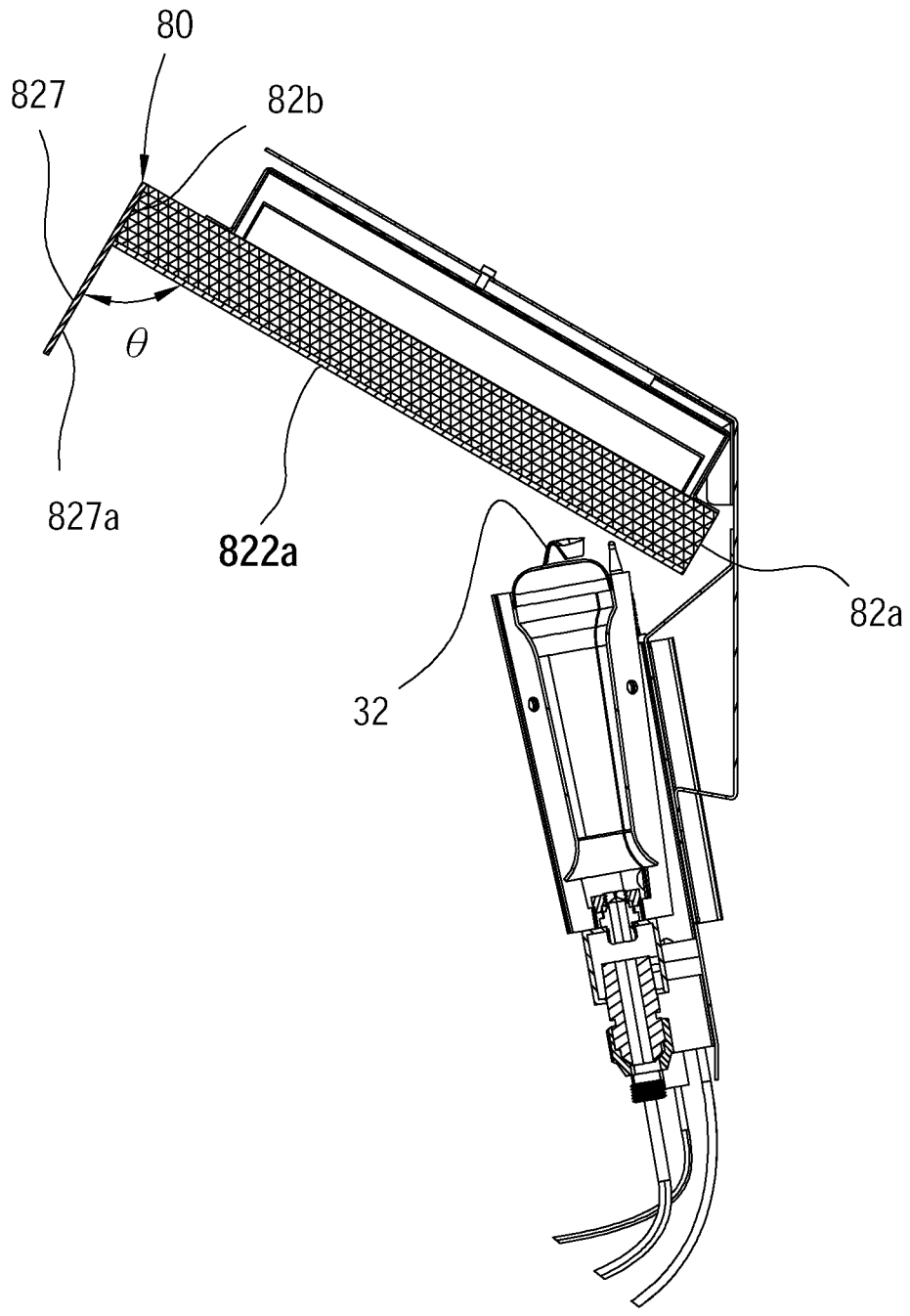
FIG. 14 is a cross-sectional view of a combustion device having the infrared ray generation mesh of the eighth embodiment.

As illustrated in FIG. 14, through the way to dispose the retaining mesh 827, the infrared ray generation mesh is heated by open fire out of the flame outlet 32. Wherein, the open fire flows along the corrugations 826 from the first part 82*a* to the second part 82*b* and is partly blocked by the retaining mesh 827, such that the thermal energy of open fire is accumulated on the infrared ray generation mesh 80, increasing the infrared intensity generated by the combustion device.

Figure 15:
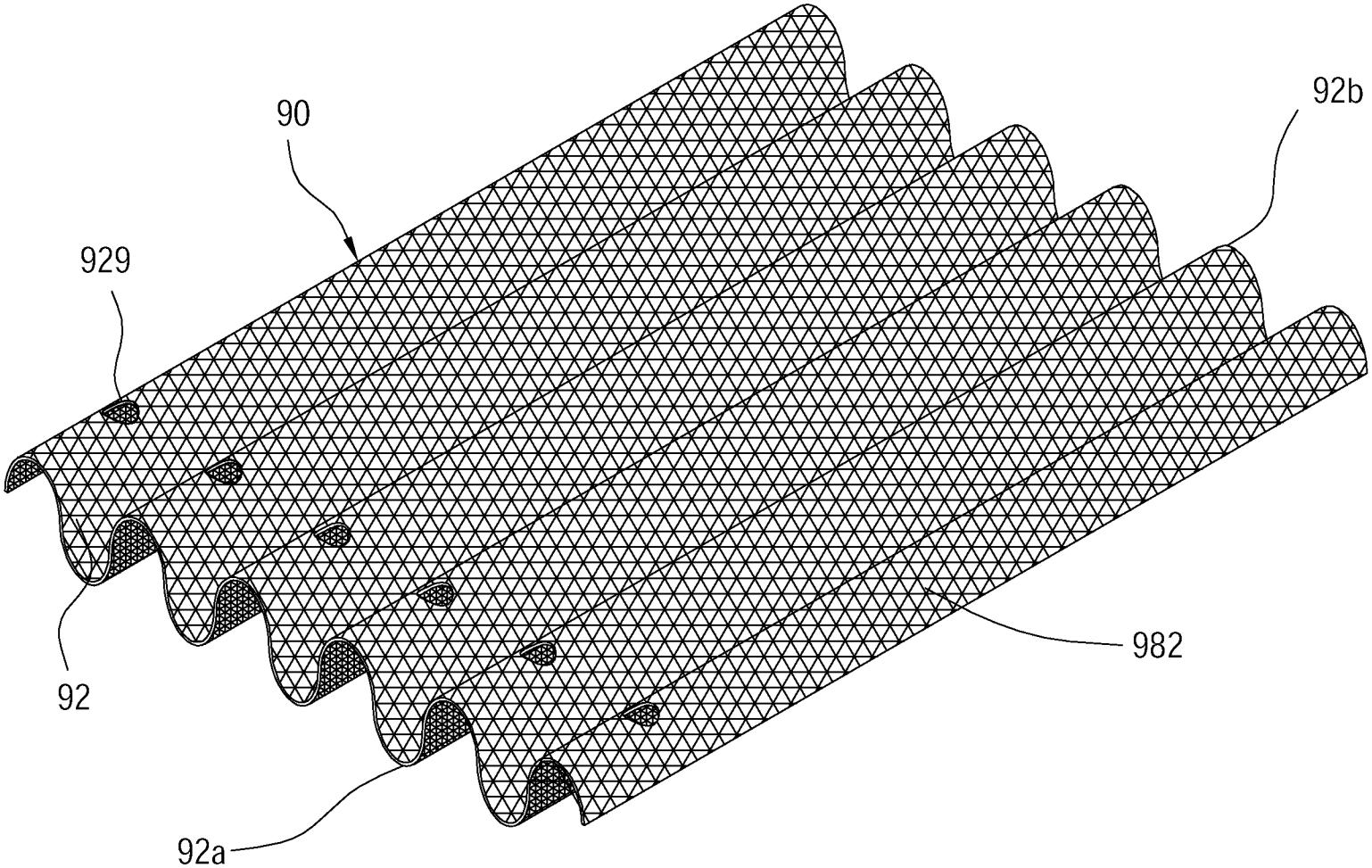
FIG. 15 is a perspective view of an infrared ray generation mesh of a ninth embodiment.

An infrared ray generation mesh 90 of a ninth embodiment of the present embodiment is shown in FIG. 15. The infrared ray generation mesh 90 includes a structure which is similar to that of the first embodiment. The infrared ray generation mesh 90 is different from that of the first embodiment in that the infrared ray generation mesh 90 has a plurality of holes 929 near the first part 92*a*. The holes 929 are also located near the flame outlet 32, whereby part of the flames generated by the flame outlet 32 enters the first surface 982 of the infrared ray generation mesh 90 to the second surface 984 through the holes 929 and flows along the backside of the infrared ray generation mesh 90 from the first part 92*a* to the second part 92*b*. Thus, the infrared intensity emitted by the infrared ray generation mesh 90 near the second part 92*b* is increased, and the infrared intensity emitted by the overall infrared ray generation mesh 90 is thereby enhanced.

In addition, an infrared ray generation mesh of a tenth embodiment of the present invention as the following includes a structure which is similar to that of the ninth embodiment. The infrared ray generation mesh of the current embodiment is different from that of the ninth embodiment in that the infrared ray generation mesh has a first area and a second area. In the current embodiment, the first area need not have holes like the holes 929 in the ninth embodiment. The first area and the second area have different cover rates per unit area, wherein the first area close to the flame outlets 32 has a smaller cover rate while the second area far away from the flame outlets 32 has a greater cover rate. Both cover rates range from 43% to 64% but are different from each other. Through different cover rates, as the infrared ray generation mesh 90 is heated by the open fire of the flame outlets 32, part of the open fire passes more easily from the first area which has a smaller cover rate through the infrared ray generation mesh and flows along the backside of the infrared ray generation mesh 90 from the first part 92*a* to the second part 92*b*. Since the second area has a greater cover rate, more thermal energy generated by the open fire could be accumulated on the second area of the infrared ray generation mesh 90 and generate higher infrared intensity so as to increase the infrared intensity emitted by the infrared ray generation mesh 90 near the second part 92*b* and thereby enhance the infrared intensity emitted by the overall infrared ray generation mesh 90.

It must be pointed out that the embodiments described above are only some embodiments of the present invention. All equivalent structures which employ the concepts disclosed in this specification and the appended claims should fall within the scope of the present invention.

What is claimed is:

1. An infrared ray generation mesh system, comprising:

a burner;

a mesh body including a first surface and a second surface positioned back-to-back and a peripheral edge having a first part and a second part on opposite ends of the peripheral edge, the first and second surfaces being substantially smooth, the mesh body being bent or folded integrally to form a plurality of corrugations, each of the corrugations extending straight from the first part to the second part; and the mesh body being flame heated, by the burner, to thereby to generate the infrared rays and direct the rays onto to an object;

wherein the mesh body has a middle part and two side parts, the two side parts are located respectively on opposite sides of the middle part, the corrugations form a plurality of first crests on the first surface, and the corrugations form a plurality of second crests on the second surface; wherein the plurality of first crests and the plurality of second crests extend in a lengthwise direction, wherein the plurality of first crests and the plurality of second crests run parallel in a substantive orthogonal direction; and wherein the distances from each of the plurality of first crests to both orthogonally adjacent crests of the plurality of corresponding one of the plurality of second crests on the middle part are larger than the distance from each of the plurality of first crests to both orthogonally adjacent crests of the plurality of second crests on each of the side parts, such that infrared rays emitted by the first surface of the mesh body result in a wider heating range of the system;

wherein the first crests are located on a first reference surface, wherein the first reference surface is a curved surface, and wherein the spacing along the first reference surface between two adjacent first crests increases from the middle part toward the side parts.

2. The infrared ray generation mesh system of claim 1, wherein cross sections of the corrugations are waved.

3. The infrared ray generation mesh system of claim 1, wherein cross sections of the corrugations are serrated.

4. The infrared ray generation mesh system of claim 1, wherein the second crests are located on a defined second reference surface.

5. The infrared ray generation mesh system of claim 4, wherein the second reference surface is a flat surface.

6. The infrared ray generation mesh system of claim 1, further comprising at least one fixation bar, wherein the at least one fixation bar is joined to the corrugations.

7. The infrared ray generation mesh system of claim 1, further comprising at least one fixation bar, wherein the at least one fixation bar penetrates the corrugations.

8. The infrared ray generation mesh system of claim 1, wherein a spacing between two adjacent first crests and a spacing between two adjacent second crests are getting larger from the first part toward the second part.

9. The infrared ray generation mesh system of claim 1, wherein the corrugations extend along the same direction.

10. The infrared ray generation mesh system of claim 1, further comprising a retaining mesh joined to the second part, wherein an angle is formed between the retaining mesh and a long axis of each of the first crests on the mesh body.

11. The infrared ray generation mesh system of claim 10, wherein the angle is equal to or greater than 90 degrees.

12. The infrared ray generation mesh system of claim 1, wherein a peripheral edge of the mesh body is a rectangular shape, a peripheral edge of the mesh body has four edges, two of the opposite edges form the first part and the second part.

13. The infrared ray generation mesh system of claim 1, wherein a peripheral edge of the mesh body is a circular shape, the peripheral edge is divided into two halves, the first part and the second part are located respectively on the two halves.

14. The infrared ray generation mesh system of claim 1, wherein the mesh body has a plurality of holes near the first part.

15. The infrared ray generation mesh system of claim 1, wherein the mesh body has a cover rate per unit area, the cover rate ranges from 43% to 64%.

16. The infrared ray generation mesh system of claim 15, wherein the mesh body has a first area and a second area, the mesh body has the cover rate per unit area on the first area and has another cover rate per unit area on the second area, the another cover rate ranges from 43% to 64% and is different from the cover rate.

17. The infrared ray generation mesh system of claim 16, wherein the cover rate of the first area is smaller than the another cover rate of the second area.

* * * * *